United States Patent [19]

Tingley

[11] Patent Number: 4,554,936

[45] Date of Patent: Nov. 26, 1985

[54] WASHING MACHINE CONTAINER COUPLING APPARATUS

[75] Inventor: James E. Tingley, Erie, Pa.

[73] Assignee: American Sterilizer Company, Erie, Pa.

[21] Appl. No.: 590,408

[22] Filed: Mar. 16, 1984

[51] Int. Cl.[4] ..... B08B 3/04

[52] U.S. Cl. ..... 134/146; 134/152; 137/238

[58] Field of Search ..... 134/44, 51, 56 R, 56 D, 134/84, 85, 92, 114, 136, 145, 146, 152; 137/238, 542; 251/156, 321, 322, 323

[56] References Cited

U.S. PATENT DOCUMENTS

| | | | |
|---|---|---|---|
| 709,698 | 9/1902 | Colby et al. | 134/146 X |
| 784,755 | 3/1905 | Pein | 134/44 |
| 927,320 | 7/1909 | Blum | 134/44 |
| 3,070,104 | 12/1962 | Faust et al. | 134/145 |
| 3,285,779 | 11/1966 | Dunham | 134/44 |
| 3,413,987 | 12/1968 | Brown | 134/46 |
| 3,590,863 | 7/1971 | Faust et al. | 134/144 |
| 3,746,022 | 7/1973 | Fillion et al. | 134/145 X |
| 3,756,273 | 9/1973 | Hengesbach | 137/542 X |
| 3,760,825 | 9/1973 | Barnun | 134/56 D |

FOREIGN PATENT DOCUMENTS

| | | | |
|---|---|---|---|
| 141592 | 2/1960 | Australia | 134/44 |

*Primary Examiner*—Philip R. Coe
*Assistant Examiner*—Frankie L. Stinson
*Attorney, Agent, or Firm*—Robert D. Yeager; Christine R. Ethridge

[57] ABSTRACT

Apparatus for selectively coupling a source of pressurized fluid to washing machine containers which hold items during wash cycles where there are first containers adapted for preventing the flow of fluid and second containers adapted for receiving the fluid when the containers are placed in their normal positions in the washing machine. The apparatus includes a member having a contoured passage therethrough and which defines an inlet and an outlet and means slidably disposed within the member for controlling the flow of fluid through the outlet to the containers. The flow control means has a first portion, which may include a body and a flange and a second portion which may be an elongate pin. The first portion is adapted for such engagement with the contours of the passage that the flow control means can assume a first position for preventing the flow and a second position for permitting the flow. The second portion is adapted for such engagement with the containers that the flow control means assumes the first position when the pin engages the first container and assumes the second position when the pin engages the second container.

6 Claims, 6 Drawing Figures

WASHING MACHINE CONTAINER COUPLING APPARATUS

BACKGROUND OF THE INVENTION

1. Field of the Invention

The present invention relates to devices for coupling a source of fluid to a container, and more particularly to an apparatus for selectively coupling a source of pressurized fluid to washing machine containers.

2. Description of the Prior Art

Automatic washing machines or washer sterilizers which are adapted for specialized applications employ a variety of specially designed containers to hold particular items during wash cycles. Some of the containers are equipped with a manifold for receiving and directing fluid onto irregularly shaped items, such as bottles or bedpans. Other containers which are designed to hold items not requiring any specialized fluid application, do not include manifolds.

Conventional apparatus for coupling the source of the fluid, such as the machine piping, to the container manifold are known to leak when containers which do not include such manifolds are in use. Because the coupling apparatus does not engage a manifold, the fluid will not be directed into the container, but will enter the coupling device and leak into the washing machine. Fluid pressure to other fluid inlets is decreased because of the leaking.

Problems have been encountered with the seals used on the conventional coupling apparatuses. The seal presses directly against the container and must be pressed with sufficient force to prevent water flow into the washing machine when a container without a manifold is in use. The seals are known to have a short lifespan. As the seal becomes less serviceable, leaking increases.

There is a need for a coupling apparatus which does not leak or permit fluid flow when a container not having a manifold is employed. There is also a need for such an apparatus which does not leak but does permit fluid flow when a container with a manifold is employed.

U.S. Pat. Nos. 3,413,987; 3,285,779; 3,590,863; and 3,760,825 disclose valves for use with washing machines which permit the flow of fluid when the valve is coupled to one type of container and redirect the flow when the valve is coupled to a different type of container. In the systems disclosed by these patents, the valves either divert the fluid to another outlet or are unable to respond to differently designed containers. There is a need, therefore, for a coupling device which prevents the flow of fluid through a particular conduit by responding to the container being employed.

SUMMARY OF THE INVENTION

The present invention provides apparatus for selectively coupling a source of pressurized fluid to washing machine containers which hold items during wash cycles. There are first containers which are adapted to prevent the flow of fluid and second containers which are adapted to receive the flow when the respective containers are placed in their normal positions in the washing machine.

The apparatus includes a member having a contoured passage therethrough and which defines an inlet and an outlet and means slidably disposed within the member for controlling the flow of fluid through the outlet to the container. The flow control means has a first portion adapted for such engagement with the contours of the passage that the fluid control means can assume a first position for preventing the flow. The flow control means has a second portion adapted for such engagement with the container that the flow control means assumes the first position when the second portion engages the first container and assumes the second position when the second portion engages the second container. The apparatus also includes means for sealing the couple between the fluid source and the container.

In the preferred embodiment, the passage may have a first bore, a second bore having a greater width than the first bore and a shoulder formed between the first and second bores. The first portion of the flow control means may include a body and a flange. The second portion of the flow control means may be an elongate pin which extends from the body through the outlet for engagement with the container.

The first position is preferably one in which the pin is in such engagement with the first container that the body is disposed entirely within the first bore and the flange is in such sealing engagement with the shoulder that fluid cannot flow through the outlet. The second position is preferably one in which the pin is in such engagement with the second container that the flow of pressurized fluid can so move the flange out of engagement with the shoulder and can move so much of the body into the second bore that the fluid can flow through the outlet into the second container. The second bore is proportioned to permit the flow of fluid in such volume and at such pressure when said body is in said second position that a predetermined sufficient flow is delivered to the second container.

The couple sealing means may be a top, preferably made of a material resistant to rapid temperature extremes, which engages both the member adjacent the outlet, and the container. The top has an opening therethrough through which the pin can extend.

The apparatus may further include means for guiding the pin out of the outlet through the opening. The guiding means and the flow control means are preferably made of a noncorrosive metal. The member is preferably made of a material resisant to rapid temperature extremes.

The apparatus may further include means, preferably a spring, for biasing the flow control means in the direction of the inlet of the member.

BRIEF DESCRIPTION OF THE DRAWINGS

The following detailed description of the preferred embodiment can better be understood if reference is made to the drawings in which.

DETAILED DESCRIPTION OF THE PREFERRED EMBODIMENT

Figure 1:
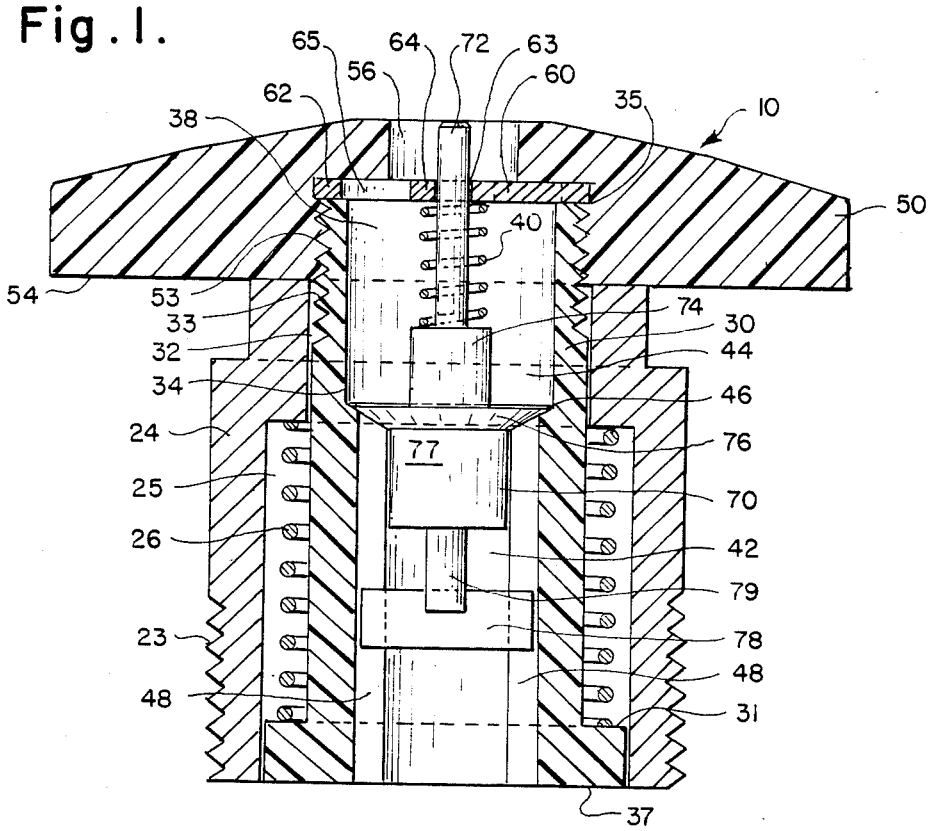
FIG 1 is a sectional view of the coupling device of the present invention.
Figure 2:
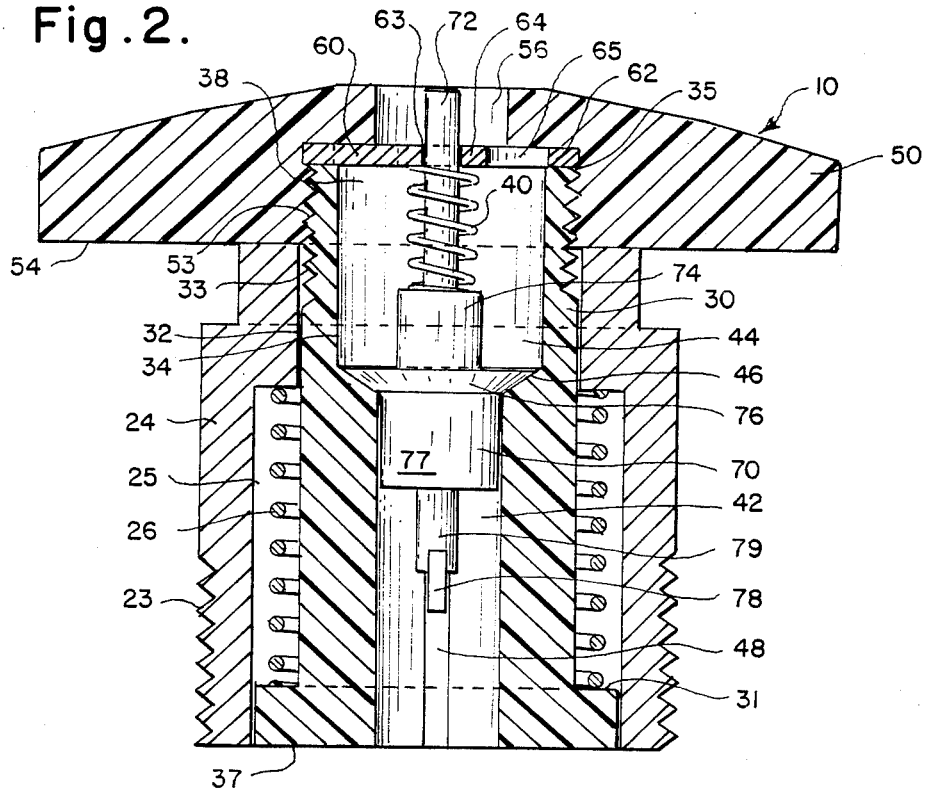
FIG. 2 is a sectional view of the device of FIG. 1 rotated ninety degrees.

FIGS. 1 through 6 illustrate the preferred embodiment of the coupling device 10 of the present invention.

The device 10 includes a member 30 which is made of any suitable material that is resistant to rapid extremes of temperature, such as Teflon® or plastics having similar properties. The device 10 also includes a top portion 50, a flow control means 70, a guide 60 and a spring 40.

The coupling device 10 is designed to respond to the presence or absence of a manifold 16 in a container which holds articles in a washing machine. The washer may be a washer sterilizer or any washing apparatus adapted for use with a source of fluid under pressure and which receives washing containers which hold articles during wash cycles. The containers 12 can be specially designed to hold irregularly shaped articles, such as bottles, bed pans or test tubes, and to direct the fluid, generally water, into hard to reach areas of the articles. Such containers are commercially available. Other containers 14 which hold articles which do not require specialized fluid application do not require manifolds 16. The manifold 16 is an element integral to one type of container 12 which can be coupled to a source of fluid and can direct the fluid to conduits attached to the manifold 16. The conduits can assume a variety of arrangements to suit the specialized needs of particular articles to be washed in the container 12. It should be appreciated that the containers 12 and 14 and the manifold 16 are not a part of the present invention. Reference to them and their features is for the purpose of description and not for limitation of the scope or potential uses of the coupling device 10 of the present invention.

Figure 5:
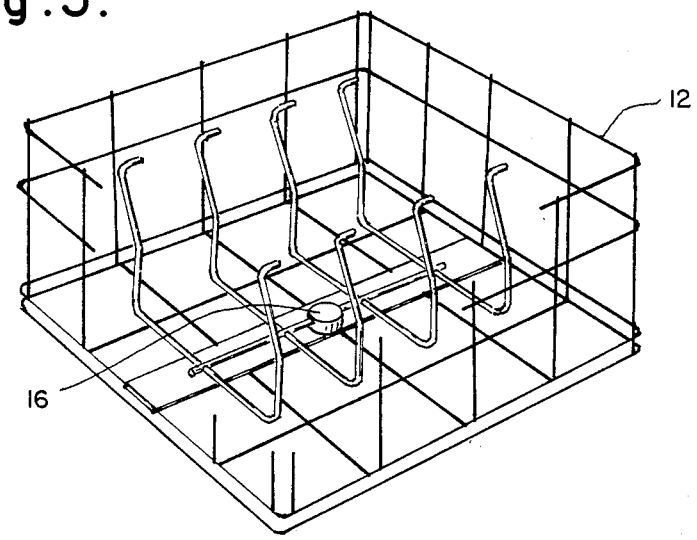
FIG. 5 is a perspective view of a container having a manifold.
Figure 6:
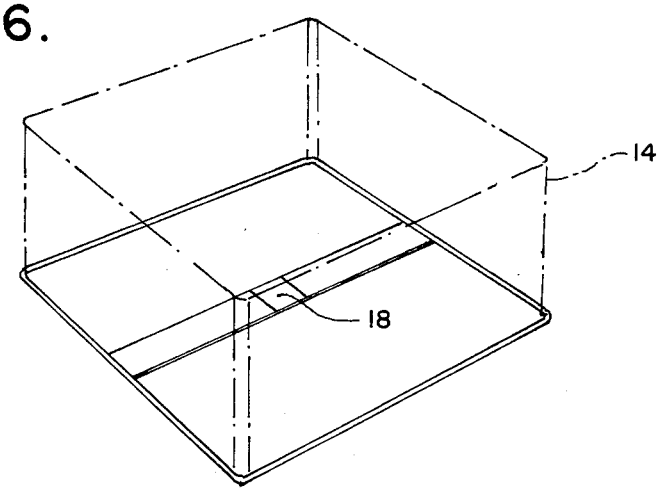
FIG. 6 is a diagrammatic view of a container without a manifold.

For purposes of description and to facilitate understanding, device 10 will be described in terms of its functional relationship with two types of commercially available washing containers 12 and 14, illustrated in FIGS. 5 and 6.

Container 12 has manifold 16. Manifold 16 has passage 15 and a curved bottom surface 17. Container 14 has plate 18. Plate 18 has curved bottom surface 19. Containers 12 and 14 are adapted for use in the chamber of a washer. The washer is adapted for connection to a conventional supply of pressurized water or some other suitable fluid. A connector 24 having a passage 25 and a threaded portion 23 joins device 10 to the water supply. A spring 26 which is disposed in passage 25 biases device 10 toward the washer and container 12 or 14 under operational circumstances.

Member 30 of coupling device 10 includes exterior surface 32, interior surface 34, inlet 36 and outlet 38. Exterior surface 32 has a threaded portion 33, a top surface 35, a bottom surface 37 and flange 31. Member 30 is slidably disposed in passage 25 of connector 24. Spring 26 rests on flange 31. Interior surface 34 includes a first bore 42 a second bore 44, shoulder 46 and two slits 48 cut into opposing surfaces of first bore 42. Fluid can flow through bores 42 and 44 and through slits 48.

Top portion 50 includes threaded portion 53 which engages threaded portion 33 of member 30, and a curved upper surface 52 which is adapted to seal against the mating curved surfaces 17 and 19 of containers 12 and 14, respectively. Top portion 50 also includes a hole 56 through its center, a flat under portion 58 extending from hole 56 to threaded portion 53 and a bottom surface 54 which engages the top of connector 24.

Guide 60 includes outer ring 62 which is pressed between the flat under portion 58 of top portion 50 and the top surface 35 of member 30. Guide 60 also includes inner ring 64, spokes 61 which extend from inner ring 64 to outer ring 62 and flow space 65 which are defined by spokes 61 and rings 62 and 64. A hole 63 is defined by inner ring 64. Flow spaces 65 permit the flow of fluid through hole 56 into container 12.

Flow control member 70 includes pin 72 which extends through hole 63 of guide 60 out of outlet 38 of member 30 and hole 56 of top portion 60. Flow control member 70 further includes stop 74, flange 76, body 77, neck 79 and guide bar 78. Guide bar 78 is a flat element having two ends, each of which can slide in one of the slits 48 of member 30. The guide bar 78 maintains flow control member 70 in alignment within the first bore 42 as it slides within member 30 during operation. Inner Ring 64 of guide member 60 aligns pin 72 as it moves in and out of outlet 38.

Figure 3:
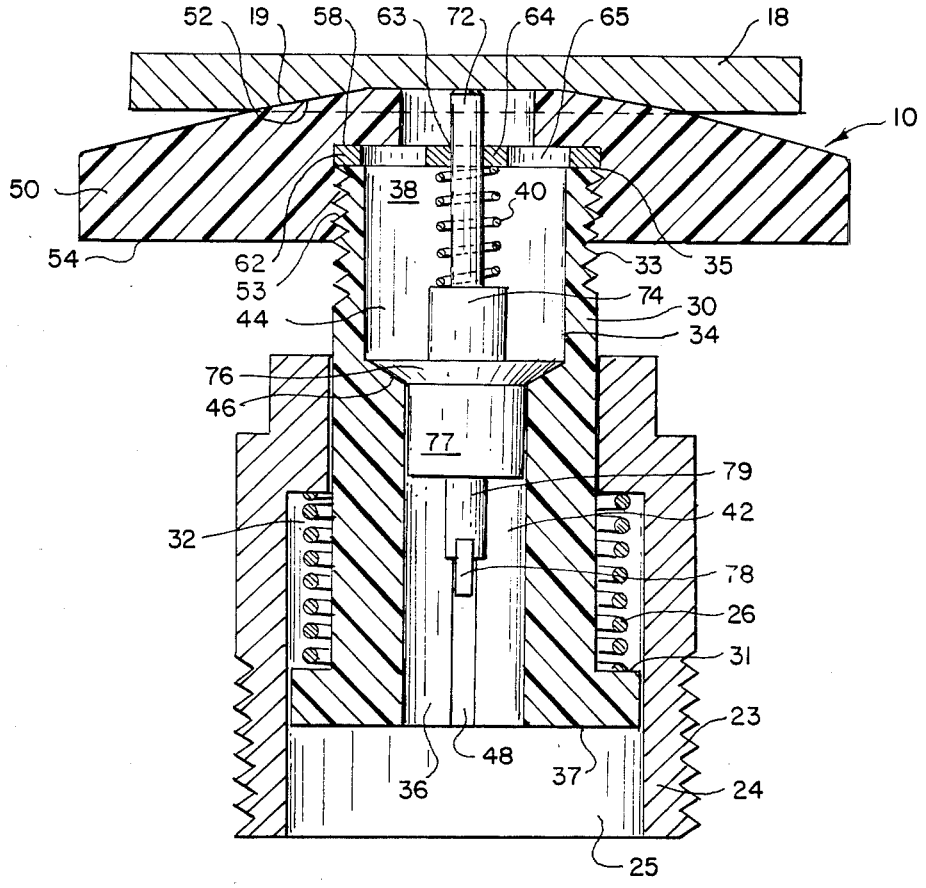
FIG. 3 is a sectional view of the device as shown in FIG. 2 in the first position contacting a first container.
Figure 4:
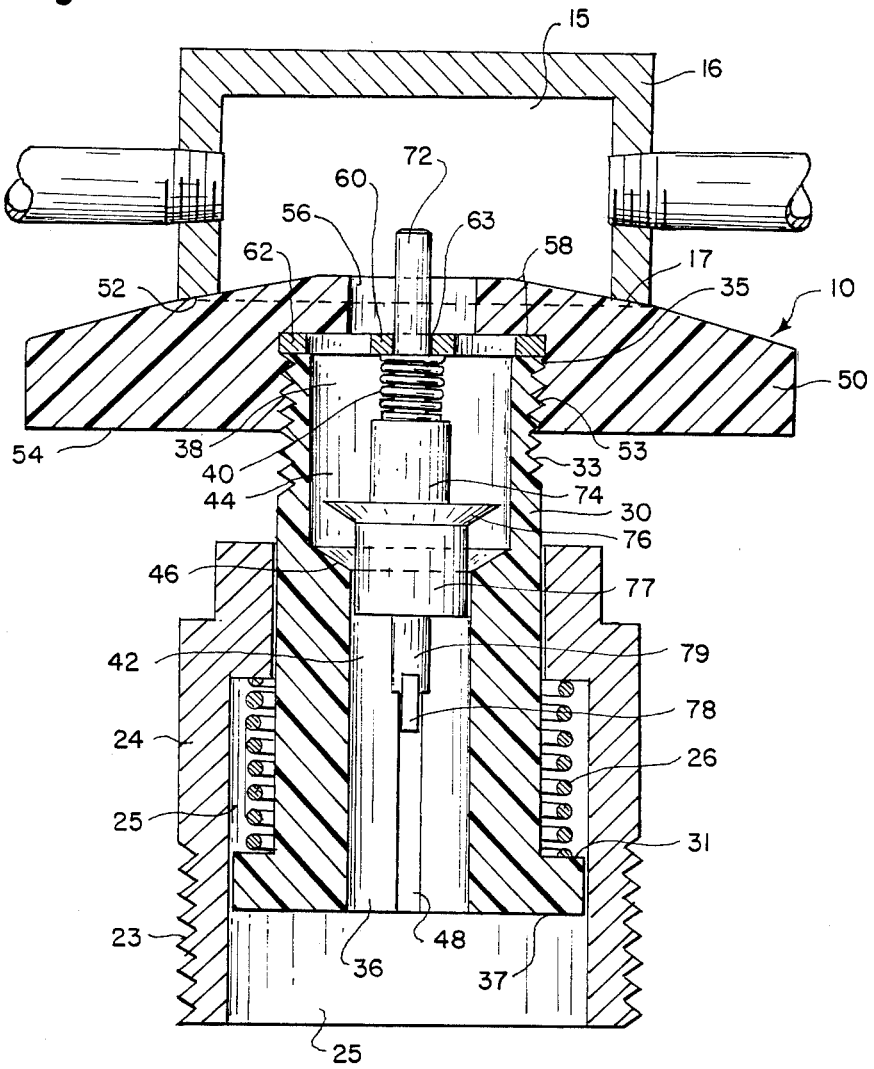
FIG. 4 is a sectional view of the device shown in FIG. 2 in the second position contacting the second container.

Pin 72 is adapted to interact with the containers 12 or 14. Referring to FIGS. 3 and 4, when container 12 having manifold 16 is in its normal position within the chamber of a washer, pin 72 is free to extend through outlet 38 into passage 15 when pressurized water forces flow control member 70 upwardly within member 30 and pushes member 30 upwardly within passage 25 of connector 24. When container 14 having plate 18 is in its normal position within chamber 22, pin 72 is stopped by plate 18 from moving upwardly within member 30 in response to the force of the pressurized water. Only member 30 can move upwardly within passage 25 in response to the pressurized water.

Flange 76 is adapted for sealing engagement with shoulder 46 of member 30 when pin 72 is prevented from moving upwards because of the presence of plate 18 on container 14. Body 77 is in the first bore 42 when flange 76 seals against shoulder 46. When pin 72 moves into passage 15, the flange 76 is lifted by the force of the pressurized water, off of shoulder 46, thereby breaking the internal seal within the member 30. Body 77 and flange 76 can move into the second bore 44 as pin 72 rises further into passage 15. Second bore 44 is wider than first bore 42 and is preferably of sufficient width to permit the flow of water in such volumes and at such pressures that the flow into passage 15 and through the conduits of manifold 16 to the articles in container 12 can be maintained at a predetermined sufficient rate of flow. Therefore, when pin 72 is in passage 15 and flange 76 and part of body 77 move into the second bore 55 of member 30, the fluid, or water, can flow into container 12.

Spring 40 surrounds pin 72 and rests on stop 74. When water pressure is removed from the manifold, spring 40 biases flow control member 70 in the direction of outlet 36 of member 30 so that pin 72 does not remain in its extended position and flange 76 returns to sealing engagement with shoulder 46.

The pressurized fluid is used to aid the seal between top portion 50 and the bottom surfaces 17 and 19 of the manifold 16 and plate 18, respectively. Coupling device 10 fits in passage 25 of connector 24, which is threaded by means of portion 23 to the machine piping and fluid source. Bottom surface 37 of member 30 is exposed to the pressurized fluid. The fluid exerts pressure against bottom surface 37 and forces the entire coupling device 10, including top portion 50 upwardly within connector 24 to a sufficient degree to press the curved upper surface 52 of top portion 50 against the mating curved upper surfaces 17 or 19 of containers 12 or 14, respectively. That amount of pressure aids in the prevention of leaking. Together with the internal seal within member 30 between flange 76 and shoulder 46 which prevents the flow of the pressurized fluid through outlet 38 of member 30 when container 14 is in place, the device 10 provides a coupling device which does not leak and either permits or prevents the flow of fluid in response to the type of container 12 or 14 being used in the washer.

The flow control member 70 and the guide 60 are preferably made of a noncorrosive metal, such as stainless steel or brass. The top portion 50 and member 30 are preferably made of a material which is resistant to the rapid extreme temperature changes associated with washers and washer sterilizers. Such materials contribute to the prolonged useful life of the coupling device and sealing surfaces.

What is claimed is:

1. Apparatus for selectively coupling a source of pressurized fluid to washing machine containers which hold items during wash cycles where there are first containers adapted to prevent the flow of fluid and second containers adapted to receive the fluid when the respective containers are placed in their normal positions in the washing machine, comprising:

a member having a contoured passage therethrough, said member defining an inlet and an outlet;

said passage having a first bore, a second bore having a greater width than said first bore and a shoulder formed between said first and second bores;

means slidably disposed within said member for controlling the flow of the fluid through said outlet to the container, said flow control means having a first portion structured to permit such engagement with the contours of said passage that said flow control means can assume a first position for preventing the flow and a second position for permitting the flow, and said flow control means having a second portion structured to permit such engagement with the container that said flow control member assumes said first position when said second portion engages the first container and assumes said second position when said second portion engages the second container;

said first portion of said flow control means having a body and a flange;

said second portion of said flow control means having an elongate pin extending from said body through said outlet for engagement with the container;

said first position being one in which said pin is in such engagement with the first container that said body is disposed entirely within said first bore and said flange is in such sealing engagement with said shoulder that fluid cannot flow through said outlet;

said second position being one in which said pin is in such engagement with the second container that the flow of fluid can so move said flange out of engagement with said shoulder and can move so much of said body into said second bore that the fluid can flow through said outlet into said second container, each of said bores being proportioned to permit the flow of fluid in such volume and at such pressures when said body is in said second position that a predetermined sufficient rate of can be maintained; and means for sealing the coupling.

2. Apparatus as recited in claim 1 wherein said coupling sealing means is a top in engagement with said member adjacent said outlet and structured for sealing engagement with the container, said top having an opening therethrough, through which said pin can extend.

3. Apparatus as recited in claim 2 further comprising means for guiding said pin out of said outlet through said opening.

4. Apparatus as recited in claim 3 wherein said top and said member are made of a material resistant to rapid temperature extremes and said flow control means and said guiding means are made of a noncorrosive metal.

5. Apparatus as recited in claim 1 further comprising means for biasing said flow control means in the direction of said inlet.

6. Apparatus as recited in claim 5 wherein said biasing means is a spring disposed on said second portion of said flow control means.

* * * * *

UNITED STATES PATENT AND TRADEMARK OFFICE

CERTIFICATE OF CORRECTION

PATENT NO. : 4,554,936
DATED : November 26, 1985
INVENTOR(S) : James E. Tingley

It is certified that error appears in the above—identified patent and that said Letters Patent is hereby corrected as shown below:

Column 6, line 22, after "of" insert --flow--.

Signed and Sealed this

*Twenty-second* Day of *April 1986*

[SEAL]

*Attest:*

DONALD J. QUIGG

*Attesting Officer*

*Commissioner of Patents and Trademarks*